US011015607B2

(12) United States Patent
Suematsu et al.

(10) Patent No.: US 11,015,607 B2
(45) Date of Patent: May 25, 2021

(54) MOTOR PUMP

(71) Applicant: MITSUBISHI HEAVY INDUSTRIES, LTD., Tokyo (JP)

(72) Inventors: Junichi Suematsu, Tokyo (JP); Takeshi Sano, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 119 days.

(21) Appl. No.: 16/390,554

(22) Filed: Apr. 22, 2019

(65) Prior Publication Data

US 2019/0360474 A1 Nov. 28, 2019

(30) Foreign Application Priority Data

Apr. 25, 2018 (JP) ..... JP2018-084533

(51) Int. Cl.
*F04D 17/12* (2006.01)
*F04D 25/06* (2006.01)
*F04D 29/58* (2006.01)

(52) U.S. Cl.
CPC ..... *F04D 17/12* (2013.01); *F04D 25/0606* (2013.01); *F04D 29/5806* (2013.01)

(58) Field of Classification Search
CPC .... F04D 17/12; F04D 13/025; F04D 25/0626; F04D 29/584; F04D 29/5806
See application file for complete search history.

(56) References Cited

U.S. PATENT DOCUMENTS

2015/0093256 A1* 4/2015 Mariotti ..... F04D 17/12 417/53

FOREIGN PATENT DOCUMENTS

| | | |
|---|---|---|
| JP | 53-84202 | 7/1978 |
| JP | 54-140201 | 10/1979 |
| JP | 60-98195 | 6/1985 |
| JP | 2001-234883 | 8/2001 |

* cited by examiner

*Primary Examiner* — Kenneth J Hansen
(74) *Attorney, Agent, or Firm* — Wenderoth, Lind & Ponack, L.L.P.

(57) ABSTRACT

A motor pump includes a shaft rotatable around an axis, a driving section including a rotor core integrally fixed to an outer circumference of the shaft and a stator surrounding an outer circumference of the rotor core, a compression section configured to compress a working fluid, a casing surrounding the shaft, the driving section, and the compression section, a partition radially partitioning an inside of the casing into a first space in which the stator is disposed and a second space in which the rotor core is disposed, a first connection path connecting the first space to a first portion of the compression section, and a second connection path connecting the second space to a second portion of the compression section in which a pressure of the working fluid is higher than that of the first portion.

10 Claims, 3 Drawing Sheets

MOTOR PUMP

FIELD OF THE INVENTION

The present invention relates to a motor pump. Priority is claimed from Japanese Patent Application No. 2018-84533, filed Apr. 25, 2018, the content of which is incorporated herein by reference.

DESCRIPTION OF RELATED ART

For example, as a device for pumping a fluid containing harmful substances such as ammonia, one disclosed in Japanese Unexamined Patent Application, First Publication No. S60-98195 is known. Japanese Unexamined Patent Application, First Publication No. S60-98195 discloses a motor pump including a motor for rotating a shaft, a pump for pressurizing and pumping a fluid according to rotation of the shaft, a casing for covering the motor and the pump, and the pressure variation absorption unit. The motor includes a stator provided on the casing side, a rotor provided on the shaft, and a cylindrical can partitioning between the stator and the rotor. That is, in this motor pump, since the space inside the motor is partitioned by the can, the motor and the pump can be covered by an integral casing. This eliminates the need to provide a shaft-sealing portion between the motor and the pump, thereby reducing the likelihood of occurrence of fluid leakage.

Since a fluid pressurized by the pump flows in a space on the rotor side (a space inside the can) inside the motor, the pressure thereof is higher than a space on the stator side (a space outside the can). The pressure variation absorption unit is provided to eliminate the pressure difference. The pressure variation absorption unit includes a communicating pipe extending from the space inside the can toward the outside of the casing, a container provided in the communicating pipe, and a flexible membrane material that partitions a space inside the container. When the pressure of the space inside the can rises, the membrane material is deformed, and thereby the pressure of the space inside the can is maintained at the same pressure as that in the space outside the can.

SUMMARY OF INVENTION

It is known that a bottomed cylindrical member such as that described above can sufficiently resist a tension due to an internal pressure while being weak in response to a compressive force due to an external pressure. That is, it is not necessarily advantageous to make the internal and external pressures of the can be the same in consideration of the pressure resistance of the can such as in the motor pump disclosed in Japanese Unexamined Patent Application, First Publication No. S60-98195. Also, in the space on the rotor side inside the motor (the space inside the can), the pressure fluctuates due to rotation of the rotor. Therefore, when the pressure of the space on the rotor side (the space inside the can) and the pressure of the space on the stator side (the space outside the can) are equalized, the internal pressure of the can does not necessarily become higher than the external pressure. That is, there is still room for improvement in the device disclosed in Japanese Unexamined Patent Application, First Publication No. S60-98195.

The present invention has been made to solve the above-described problems, and it is an objective of the present invention to provide a motor pump with further enhanced performance.

Solution to Problem

According to a first aspect of the present invention, a motor pump includes a rotating shaft rotatable around an axis, a driving section including a rotor core integrally fixed to an outer circumference of the rotating shaft and a stator surrounding an outer circumference of the rotor core, a compression section configured to compress working fluid by rotating together with the rotating shaft, a casing surrounding the rotating shaft, the driving section, and the compression section, a partition member radially partitioning the inside of the casing into a first space in which the stator is disposed and a second space in which the rotor core is disposed, a first connection path connecting the first space to a first portion in the compression section, and a second connection path connecting the second space to a second portion in which the pressure of the working fluid is higher than that of the first portion in the compression section.

According to this configuration, the first space in which the stator is disposed is connected to the first portion of the compression section by the first connection path. Further, the second space in which the rotor core is disposed is connected to the second portion of the compression section by the second connection path. In the second portion, the pressure of the working fluid is higher than the pressure of the working fluid of the first portion. Therefore, the pressure in the second space can be made higher than the pressure in the first space. That is, the pressure inside the partition member is higher than that outside the partition member. As a result, a load on the partition member can be reduced. In other words, the thickness and strength required of the partition member can be reduced. Accordingly, noise such as an eddy current generated between the stator and the rotor core can be suppressed, and performance of the driving section can be enhanced.

According to a second aspect of the present invention, the motor pump may further include a pressure-equalizer provided on the first connection path to partition the first connection path into a first region close to the first portion and a second region close to the first space and configured to adjust so that the pressure on the first region close to the first portion is equalized with the pressure on the second region close to the first space from each other.

According to this configuration, the first connection path is partitioned into the first region close to the first portion and the second region close to the first space by the pressure-equalizer. Therefore, the working fluid flowing through the compression section (the first portion) does not flow into the driving section (the first space). Therefore, fluid of which type is different from the working fluid can be caused to flow in the first space. For example, a fluid having better electrical insulation properties than the working fluid can be caused to flow in the first space. As a result, since the noise generated between the rotor core and the stator is further reduced, the performance of the driving section can be further enhanced.

According to a third aspect of the present invention, the pressure-equalizer may include a cylinder tube provided on the first connection path, and a piston capable of being moved in a space of the cylinder tube between the first region of the first portion and the second region of the first space.

According to this configuration, the piston is moved in the cylinder tube in accordance with the pressure difference between the first region of the first portion and the second region of the first space. That is, when the pressure on the second region close to the first space rises, the piston is moved to the first region close to the first portion, causing a change in volumes of the first and second regions on both sides of the piston in the cylinder tube. As a result, the pressure difference between the first portion and the first space is reduced. That is, the pressure of the first space can be changed so as to be equalized with the pressure of the first portion.

According to a fourth aspect of the present invention, the first connection path may be a pipe installed outside the casing and connected from the first portion to the first space, and the second connection path may be a space between the casing and the rotating shaft between the compression section and the driving section.

According to this configuration, since the first connection path is a pipe passing through the outer side of the casing, assembly or maintenance can be performed more easily compared to, for example, a case in which the first connection path is formed inside the casing. Further, since the second connection path is a space between the casing and the rotating shaft, the overall structural dimensions of the device can be reduced compared to a case in which the second connection path is formed by piping.

According to a fifth aspect of the present invention, the motor pump may further include a third connection path connecting the second space to a third portion of the compression section in which the pressure of the working fluid is lower than that of the second space, and the pressure adjuster provided on the third connection path and causing the working fluid to flow in a state in which the pressure of the working fluid flowing in a third region close to the second space is higher than the pressure of the working fluid flowing in a fourth region close to the third portion in the third connection path.

According to this configuration, the second space and the third portion are connected by the third connection path, and the pressure adjuster is provided on the third connection path. The pressure adjuster maintains a state in which the pressure of the working fluid flowing in the third region close to the second space is higher than the pressure of the working fluid flowing in the fourth region close to the third portion. Therefore, the working fluid can be caused to flow more smoothly toward the compression section (the third portion) without accumulating in the second space. As a result, cooling of the rotor core by the working fluid can be further promoted.

According to a sixth aspect of the present invention, the partition member may be formed of a material having electrical insulation properties.

According to this configuration, since the partition member is formed of a material having electrical insulation properties, the likelihood that noise such as an eddy current will be generated between the rotor core and the stator can be reduced. Therefore, the performance of the driving section can be enhanced.

According to a seventh aspect of the present invention, the first space may be filled with a fluid having better electrical insulation properties than the working fluid.

According to this configuration, a fluid having better electrical insulation properties than the working fluid flows in the first space. As a result, since the noise generated between the rotor core and the stator is further reduced, the performance of the driving section can be further enhanced.

According to an eighth aspect of the present invention, the compression section may include a plurality of compression stages arranged in an axial direction in the casing and gradually pressurizing the working fluid suctioned from an upstream side in the axial direction toward a downstream side in series, the first portion and the second portion may be respectively equivalent to different compression stages from each other, and the first portion may be equivalent to a compression stage on the upstream side of the second portion in the axial direction.

According to this configuration, since the compression section includes the plurality of compression stages, a head of the motor pump can be increased compared to a configuration having only one compression stage. Further, the pressure of the working fluid in each of the compression stages increases from the upstream side toward the downstream side in the axial direction. Therefore, since the first portion and the second portion are provided in different compression stages from each other, the pressure difference between the two can be dearly and easily secured. That is, the pressure difference between the first portion and the second portion can be secured without separately providing another device.

According to a ninth aspect of the present invention, the compression section may include a plurality of compression stages arranged in an axial direction in the casing and gradually pressurizing the working fluid suctioned from an upstream side in the axial direction toward a downstream side in series, the first portion and the second portion may be equivalent to the same compression stage, and the first portion may be positioned at the upstream side of the second portion in the axial direction in the compression stage.

According to this configuration, the first portion and the second portion are provided in the same compression stage, and the first portion is positioned at the upstream side of the second portion in the axial direction in the compression stage. Therefore, the pressure difference between the first portion and the second portion can be maintained while reducing the influence on pressurizing and pumping of the working fluid to a minimum. On the other hand, when the working fluid directed toward the first space and the second space is extracted from different compression stages, the pressure loss of the working fluid in each compression stage may increase, which may affect the performance of the compression section. However, according to the above-described configuration, such a likelihood can be reduced.

According to a tenth aspect of the present invention, a motor pump includes a rotating shaft rotatable around an axis, a driving section including a rotor core integrally fixed to an outer circumference of a rotating shaft and a stator surrounding an outer circumference of the rotor core, a compression section including a plurality of compression stages and configured to compress a working fluid by rotating together with the rotating shaft, a casing surrounding the rotating shaft, the driving section, and the compression section, a partition member radially partitioning the inside of the casing into a first space in which the stator is disposed and a second space in which the rotor core is disposed, a first connection path connecting the first space to a first compression stage adjacent to an upstream side of a second compression stage on the furthest downstream side in an axial direction among the plurality of compression stages included in the compression section, and a second connection path connecting the second space to the second compression stage on the furthest downstream side among the plurality of compression stages included in the compression section.

According to the present invention, a motor pump with further enhanced performance can be provided.

MODES FOR CARRYING OUT THE INVENTION

First Embodiment

Figure 1:
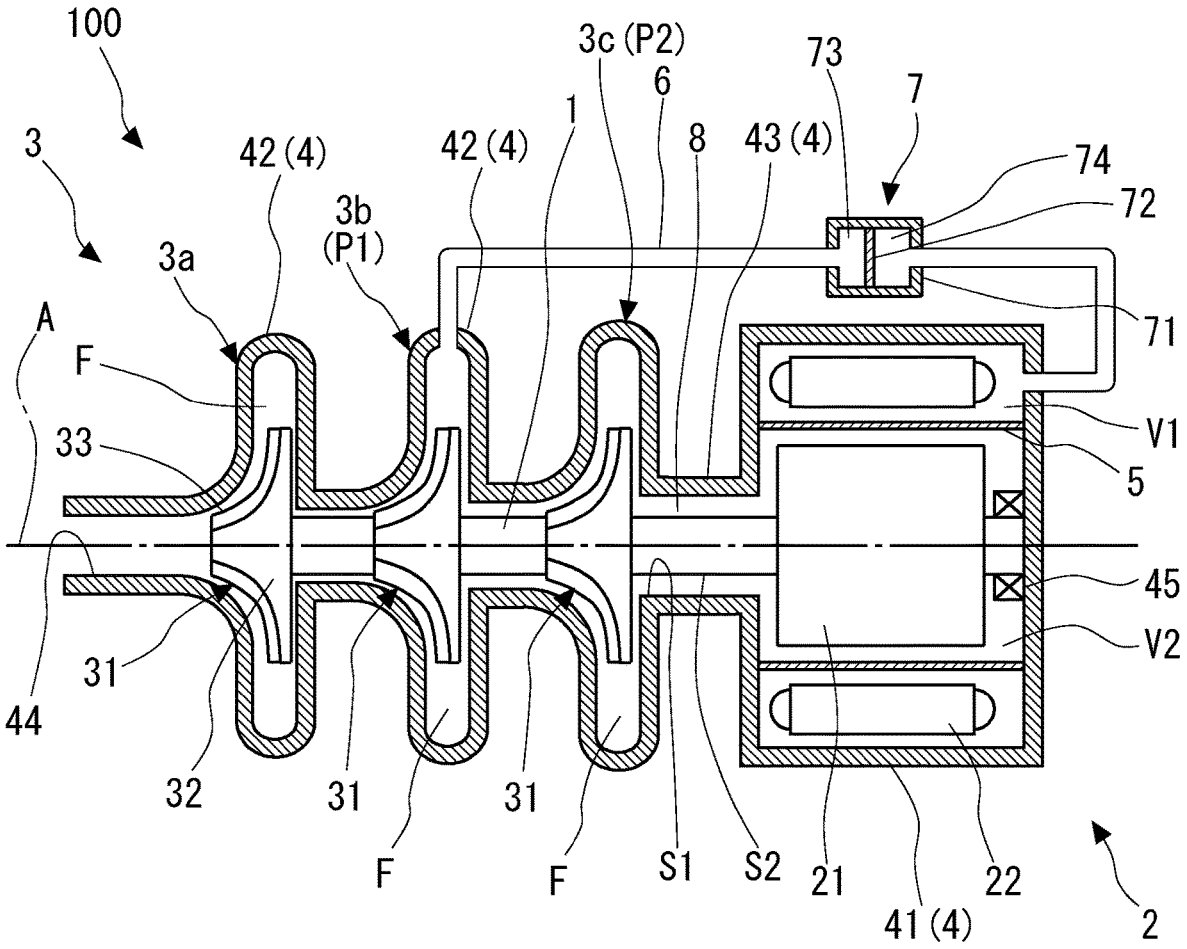
FIG. 1 is a cross-sectional view illustrating a configuration of a motor pump according to a first embodiment of the present invention.

A first embodiment of the present invention will be described with reference to FIG. 1. A motor pump 100 according to the present embodiment is used to safely pump a working fluid containing harmful substances such as ammonia without leakage to the outside. As illustrated in FIG. 1, the motor pump 100 includes a rotating shaft 1, a driving section 2, a compression section 3, a casing 4, a partition member 5, a first connection path 6, a pressure-equalizer 7, and a second connection path 8.

The rotating shaft 1 has a columnar shape extending along an axis A. The rotating shaft 1 rotates around the axis A due to a rotational force applied by the driving section 2. The driving section 2 includes a rotor core 21 integrally fixed to an outer circumference of the rotating shaft 1, a stator 22 surrounding an outer circumference of the rotor core 21, and a driving section casing 41 covering the rotor core 21 and the stator 22. Although not illustrated in detail, the rotor core 21 and the stator 22 are each formed by winding a winding wire a plurality of turns around an iron core. The driving section casing 41 covers the rotor core 21 from a radial outer side with respect to the axis A. The stator 22 is fixed to an inner circumferential side of the driving section casing 41. When a current is applied to the rotor core 21 and the stator 22, an electromagnetic force based on an induced current is generated between the rotor core 21 and the stator 22, and thereby the rotor core 21 and the rotating shaft 1 are rotationally driven around the axis A.

The compression section 3 includes a plurality of (three in the present embodiment) compression stages 3*a*, 3*b*, and 3*c* arranged in an axis A direction. The plurality of compression stages 3*a*, 3*b*, and 3*c* have the same configuration as each other. Each of the compression stages 3*a*, 3*b*, and 3*c* includes an impeller 31 integrally attached to the above-described rotating shaft 1, and the compression section casing 42 which covers the impeller 31 from the outer circumferential side. The impeller 31 includes a disc-shaped disc 32 centered on the axis A, and a plurality of blades 33 provided on a surface of the disc 32 on an upstream side of the working fluid flowing in the axis A direction. The plurality of blades 33 are radially arranged with the axis A as a center. Each of the blades 33 extends in a radial direction with respect to the axis A. Further, in a cross-sectional view including the axis A, the blade 33 is gradually curved from a radial inner side toward a radial outer side with respect to the axis A from the upstream side toward the downstream side in the axis A direction.

The compression section casing 42 covers the blades 33 from the outer circumferential side and defines a compression flow path F in which the working fluid flows between the compression section casing 42 and the blades 33. When the working fluid flows through the compression flow path F according to rotation of the impeller 31 (rotating shaft 1), the pressure of the working fluid rises. In the compression section 3, the pressure of the working fluid increases at a compression stage on the downstream side in the axis A direction. Further, although the compression section 3 includes three compression stages 3*a*, 3*b*, and 3*c* in the present embodiment, the number of compression stages can be appropriately changed according to design and specifications. Also, the compression section casing 42 is integrally connected to the driving section casing 41 via a connection casing 43. The connection casing 43 has a cylindrical shape surrounding the rotating shaft 1 from the outer circumferential side with the axis A as a center. The driving section casing 41, the compression section casing 42, and the connection casing 43 constitute a casing 4 integrally formed as a whole. A space between the compression section casing 42 and the connection casing 43 and a space between the connection casing 43 and the driving section casing 41 are sealed and there is no gap formed therebetween. A suction port 44 for introducing a working fluid before compression from the outside is formed at an end portion on the upstream side in the axis A direction of the casing 4. The working fluid compressed to a high pressure is removed from a discharge port (not illustrated) formed in the casing 4 to the outside to be used for various uses. A bearing portion 45 for rotatably supporting the rotating shaft 1 is disposed at an end portion on the downstream side in the axis A direction inside the casing 4 (driving section casing 41). Although not illustrated in detail, other bearing devices for supporting the rotating shaft 1 together with the bearing portion 45 are provided inside the casing 4.

The partition member 5 is provided inside the casing 4 (the driving section casing 41). The partition member 5 has a cylindrical shape centered on the axis A and partitions a space inside the driving section casing 41 into two in the radial direction. A space on a side radially outward from the partition member 5 is a first space V1 in which the stator 22 is disposed. The first space V1 has an annular shape centered on the axis A. A space on a side radially inward from the partition member 5 is a second space V2 in which the above-described rotor core 21 is disposed. The second space V2 has a columnar shape centered on the axis A. Between the first space V1 and the second space V2, airtightness and liquid tightness are maintained by the partition member 5. The partition member 5 is integrally formed of an electrically insulating material including, for example, a resin or a ceramic. Some of the working fluid pumped from the compression section 3 flows in the second space V2. On the other hand, a fluid (an insulating fluid) different from the working fluid flows in the first space V1. The insulating fluid has better electrical insulation properties than the working fluid.

The first connection path 6 is a piping that connects the first space V1 and the compression section 3 through an outer side of the casing 4. More specifically, one end of the first connection path 6 is connected to the first space V1, and the other end is connected to a first portion P1 in the compression section 3. The first portion P1 of the compression section 3 refers to the compression stage 3*b* on the upstream side (low pressure side) of the compression stage 3*c* on the furthest downstream side (high pressure side) in the axis A direction among the plurality of (three) compression stages 3*a*, 3*b*, and 3*c*. In the present embodiment, as an example, the second compression stage 3*b* counted from the upstream side (low pressure side) in the axis A direction is referred to as the first portion P1. More specifically, in the present embodiment, the other end of the first connection path 6 is connected to an end portion on a radial outer side of the compression flow path F formed in the compression stage 3*b*.

The pressure-equalizer 7 is provided on the first connection path 6. The pressure-equalizer 7 includes a cylindrical cylinder tube 71 and a piston 72 that moves back and forth in the cylinder tube 71. The piston 72 partitions a space in the cylinder tube 71 into two, a space 73 and a space 74. The space 73 communicates with a first region in the first connection path 6 which is close to the first portion P1, and the space 74 communicates with a second region in the first connection path 6 which is close to the first space V1. The piston 72 is moved in the cylinder tube 71 on the basis of the pressure difference between the space 74 and the space 73. Volumes of the space 74 and the space 73 change depending on the movement of the piston. Thereby, the pressure on the first region close to the space 73 is equalized with the pressure on the second region close to the space 74 from each other.

A circular tubular space extending in the radial direction with respect to the axis A is formed between an inner circumferential surface S1 of the connection casing 43 described above and an outer circumferential surface S2 of the rotating shaft 1 accommodated in the connection casing 43. This space is referred to as a second connection path 8. That is, the second connection path 8 connects the compression stage 3*c* on the furthest downstream side (high pressure side) in the axis A direction of the compression section 3 and the above-described second space V2. A working fluid compressed in the compression section 3 reaches the inside of the driving section 2 (in the second space V2) through the second connection path 8.

Next, an operation of the motor pump 100 according to the present embodiment will be described. In driving the motor pump 100, power is first supplied to the driving section 2. Thereby, the driving section 2 rotates the rotating shaft 1 around the axis A. The above-described impeller 31 rotates according to rotation of the rotating shaft 1. As a result, the working fluid introduced from the suction port 44 flows from the upstream side to the downstream side in the axis A direction and is gradually pressurized while passing through the plurality of (three) compression stages 3*a*, 3*b*, and 3*c*. The working fluid that has reached a high pressure is taken out to the outside through the discharge port formed in the casing 4. At this time, the high-pressure working fluid reaches also the inside of the second space V2 through the above-described second connection path 8. That is, the pressure of the working fluid in the second space V2 becomes equal to the pressure of the working fluid compressed by the compression section 3.

It is known that a bottomed cylindrical member such as the partition member 5 described above can sufficiently resist a tension due to an internal pressure (the pressure from the inner circumferential side) while being weak in response to a compressive force due to an external pressure (the pressure from the outer circumferential side). Therefore, as long as durability of the partition member 5 is maintained, it is desirable that the pressure of the space inside the partition member 5 (that is, the second space V2) be slightly higher than the pressure of the space outside the partition member 5 (that is, the first space V1).

Thus, in the present embodiment, the first space V1 and the first portion P1 of the compression section 3 are connected by the above-described first connection path 6. As described above, the first portion P1 refers to the compression stage 3*b* on the upstream side (low pressure side) of the compression stage 3*c* on the furthest downstream side (high pressure side) in the axis A direction among the plurality of (three) compression stages 3*a*, 3*b*, and 3*c*. In the present embodiment, the second compression stage 3*b* counted from the upstream side (low pressure side) in the axis A direction is referred to as the first portion P1. Further, the pressure-equalizer 7 is provided on the first connection path 6. When the piston 72 of the pressure-equalizer 7 moves, the volumes of the space 74 and the space 73 partitioned by the piston 72 are changed. Thereby, the pressure on the first region close to the space 73 is equalized with the pressure on the second region close to the space 74 from each other. That is, the pressure of the insulating fluid in the first space V1 becomes equal to the pressure of the working fluid in the first portion P1. The pressure of the working fluid in the first portion P1 is lower than the pressure of the working fluid in a second portion P2 (the compression stage 3*c* on a highest-pressure side in the compression section 3). Therefore, the pressure of the working fluid in the second space V2 is higher than the pressure of the insulating fluid in the first space V1. As a result, a load distribution applied to the partition member 5 is made appropriate.

As described above, according to the configuration according to the present embodiment, the first space V1 in which the stator 22 is disposed is connected to the first portion P1 of the compression section 3 by the first connection path 6. Further, the second space V2 in which the rotor core 21 is disposed is connected to the second portion P2 of the compression section 3 by the second connection path 8. In the second portion P2, the pressure of the working fluid is higher than the pressure of the working fluid in the first portion P1. Therefore, the pressure of the second space V2 can be made higher than the pressure of the first space V1. That is, the pressure inside the partition member 5 is higher than that outside the partition member 5. As a result, a load on the partition member 5 can be reduced. In other words, the thickness and strength required of the partition member 5 can be reduced. Thereby, for example, the partition member 5 can be formed of a material having electrical insulation properties such as a resin or a ceramic instead of a conventional metal. As a result, noise such as an eddy current generated between the stator 22 and the rotor core 21 can be suppressed, and performance of the driving section 2 can be enhanced. When performance of the driving section 2 is enhanced, performance of the motor pump 100 can also be enhanced.

Further, according to the above-described configuration, the first connection path 6 is partitioned into the first region close to the first portion P1 and the second region close to the first space V1 by the pressure-equalizer 7. That is, the working fluid flowing through the compression section 3 (the first portion P1) does not flow into the driving section 2 (the first space V1). Therefore, a fluid of a type different from the working fluid can be caused to flow in the first space V1. For example, a fluid having better electrical insulation properties than the working fluid can be caused to flow in the first space V1. As a result, since the noise generated between the rotor core 21 and the stator 22 is further reduced, the performance of the driving section 2 can be further enhanced.

In addition, the pressure-equalizer 7 includes the cylinder tube 71 and the piston 72. The piston 72 is moved in the cylinder tube 71 in accordance with the pressure difference between the first region close to the first portion P1 and the second region close to the first space V1. That is, when the pressure on the second region close to the first space V1 rises, the piston 72 is moved to the first region close to the first portion P1, causing a change in volumes of the first and second regions on both sides of the piston 72 in the cylinder tube 71. As a result, the pressure difference between the first portion P1 and the first space V1 is reduced. That is, the pressure of the first space V1 can be changed so as to be equalized with the pressure of the first portion P1.

In further addition, according to the above-described configuration, since the first connection path 6 is a pipe passing through the outer side of the casing 4, assembly and maintenance can be more easily performed compared to, for example, a case in which the first connection path 6 is formed inside the casing 4. On the other hand, since the second connection path 8 is a space between the casing 4 and the rotating shaft 1, the overall structural dimensions of the device can be reduced compared to a case in which the second connection path 8 is formed by piping.

Further, according to the above-described configuration, since the compression section 3 includes the plurality of compression stages 3*a*, 3*b*, and 3*c*, a head of the motor pump 100 can be increased compared to a configuration having only one compression stage. Further, the pressure of the working fluid in each of the compression stages 3*a*, 3*b*, and 3*c* increases from the upstream side toward the downstream side in the axis A direction. Therefore, since the first portion P1 and the second portion P2 are provided in different compression stages from each other, the pressure difference between the two can be dearly and easily secured. That is, the pressure difference between the first portion P1 and the second portion P2 can be secured without separately providing another device.

Although the first embodiment of the present invention has been described above, various changes and modifications can be made to the above-described configurations without departing from the gist of the present invention. For example, in the first embodiment described above, an example in which the second compression stage 3*b* counted from the upstream side in the axis A direction among the plurality of (three) compression stages 3*a*, 3*b*, and 3*c* of the compression section 3 is the first portion P1 has been described. However, the first portion P1 referred to as the compression stage 3*b* may be set as appropriate on the basis of the pressure difference between the first space V1 and the second space V2. Also, the number of compression stages provided is not limited to the above and may be two or less or four or more.

Further, in the above-described embodiment, an example in which the cylinder tube 71 and the piston 72 are used for the pressure-equalizer 7 has been described. However, the configuration of the pressure-equalizer 7 is not limited thereto, and it is also possible to employ a configuration in which a membrane material having flexibility is provided in the cylinder tube 71 as another example. In this case, since the membrane material is deformed according to the pressure difference, the same operation and effects as the piston 72 described above can be obtained.

Modified Example

Figure 2:
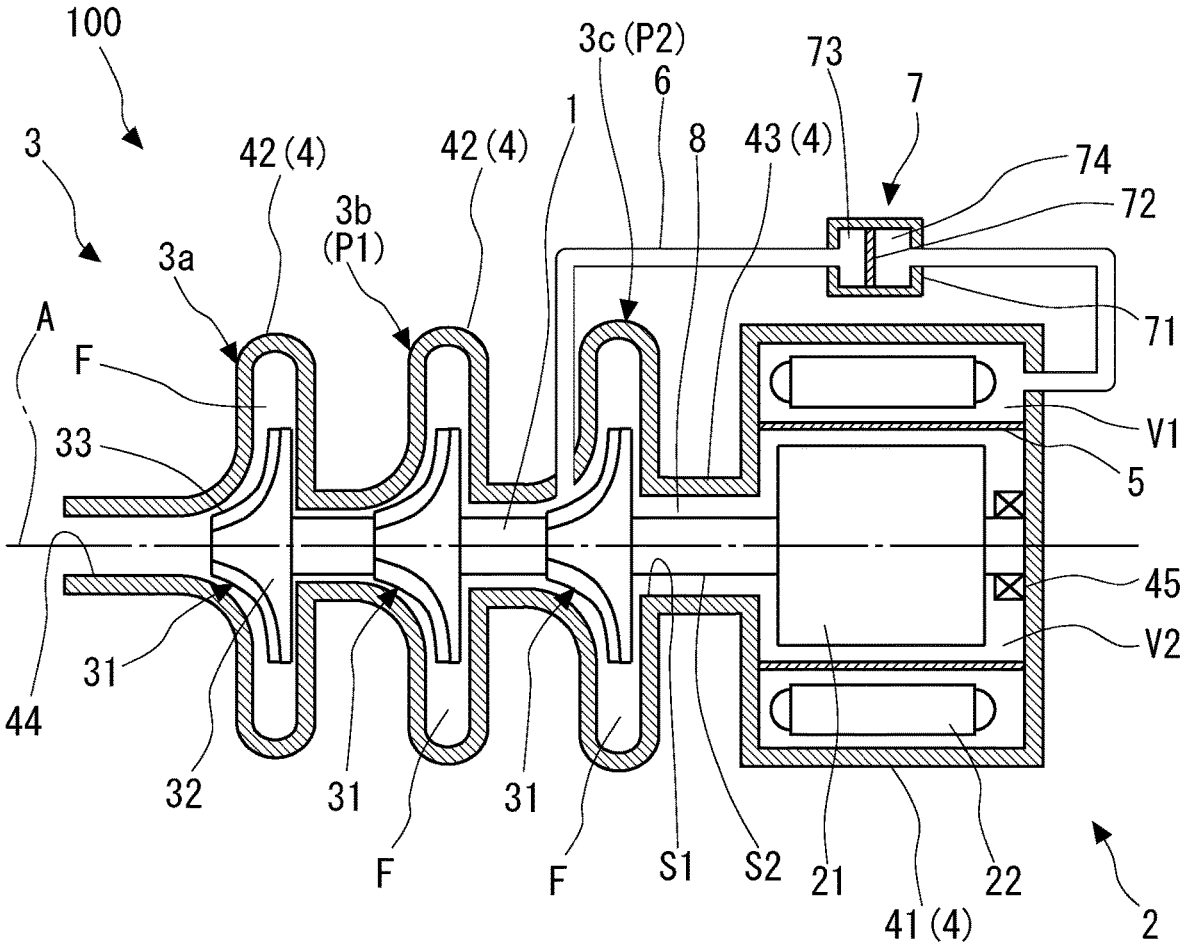
FIG. 2 is a cross-sectional view illustrating a modified example of the motor pump according to the first embodiment of the present invention.

In the above-described embodiment, an example in which the other end of the first connection path 6 is connected to a radial outermost side of the compression flow path F formed in the compression stage 3*c* has been described. However, the aspect of the first connection path 6 is not limited to the above, and for example, as illustrated in FIG. 2, it is also possible to employ a configuration in which the working fluid is extracted from an intermediate position of the compression flow path F. According to this configuration, a degree of freedom in a position at which the other end of the first connection path 6 is provided can be increased. As a result, the pressure of the insulating fluid in the first space V1 can be more accurately adjusted in accordance with the pressure of the working fluid inside the compression stage 3*c*.

Second Embodiment

Figure 3:
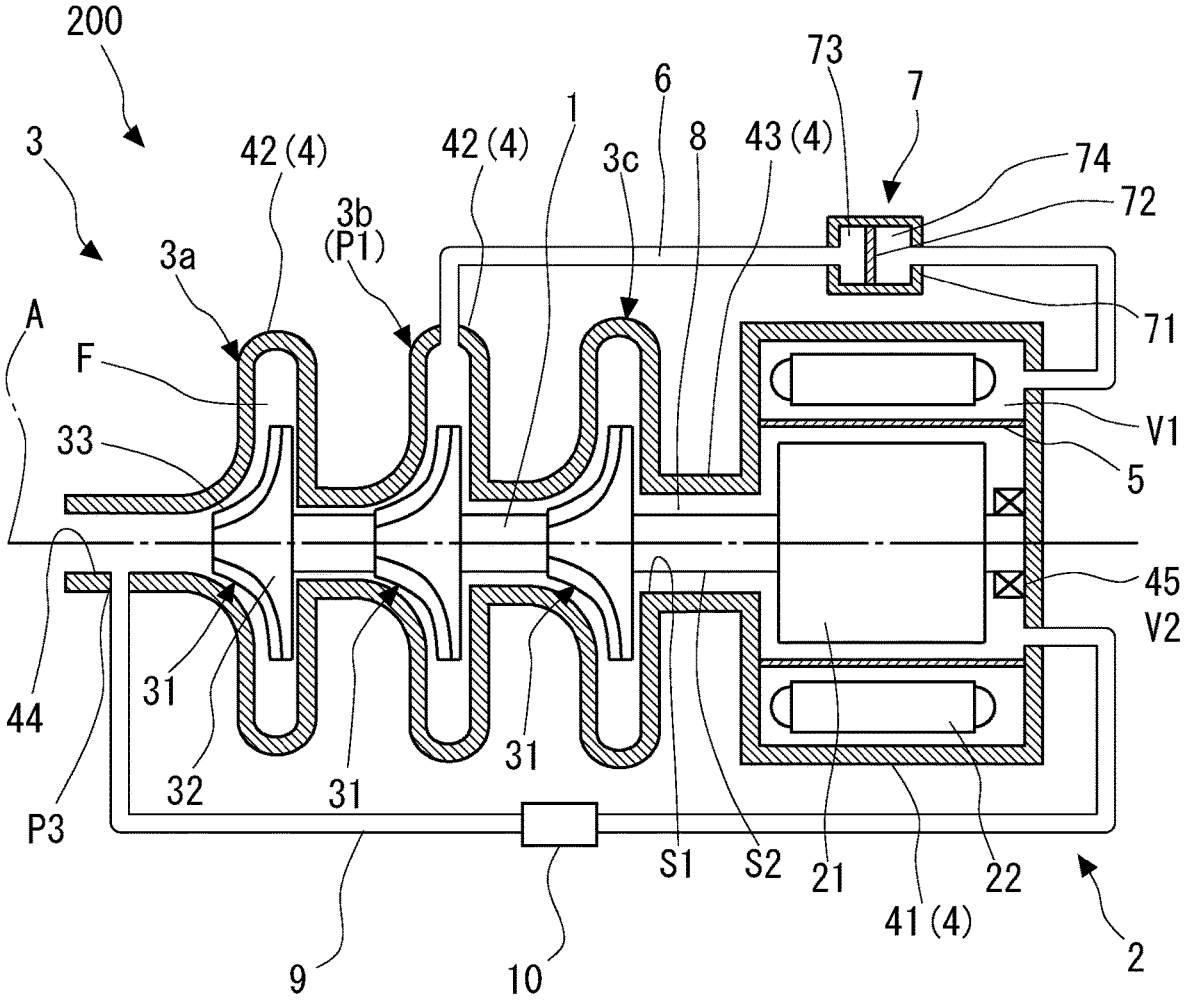
FIG. 3 is a cross-sectional view illustrating a configuration of a motor pump according to a second embodiment of the present invention.

Next, a second embodiment of the present invention will be described with reference to FIG. 3. Further, the same configurations as those in the above-described first embodiment will be denoted by the same reference signs, and detailed description thereof will be omitted. As illustrated in FIG. 3, a motor pump 200 according to the present embodiment further includes a third connection path 9 connecting a second space V2 and a compression section 3 described above, and the pressure adjuster 10.

The third connection path 9 connects the second space V2 to a portion (a third portion P3) of the compression section 3 in which the pressure of the working fluid is lower than that of the second space V2. In the present embodiment, a portion between the above-described suction port 44 and the compression stage 3*a* on the furthest upstream side (low pressure side) in the axis A direction is equivalent to the third portion P3. The pressure adjuster 10 maintains a state in which the pressure of the working fluid flowing in a third region close to the second space V2 is higher than the pressure of the working fluid flowing in a fourth region close to the third portion P3 side in the third connection path 9. More specifically, an orifice can be appropriately used as the pressure adjuster 10. The orifice is a piping member formed such that a cross-sectional area of the flow path decreases from the upstream side to the downstream side in a direction in which the pipe extends. When the working fluid passes through the orifice, the pressure of the working fluid on the downstream side of the orifice is lower compared to that on the upstream side, and a flow velocity thereof increases.

According to this configuration, the second space V2 and the third portion P3 are connected by the third connection path 9, and the pressure adjuster 10 is provided on the third connection path 9. The pressure adjuster 10 maintains a state in which the pressure of the working fluid flowing in the third region close to the second space V2 is higher than the pressure of the working fluid flowing in the fourth region close to the third portion P3. Further, a flow velocity of the working fluid in the fourth region close to the third portion P3 increases. The working fluid also contributes to cooling of a motor core in the second space V2. According to the above-described configuration, since the working fluid circulates between the compression section 3 and the driving section 2 through the third connection path 9, cooling of the rotor core 21 can be promoted compared to a case in which the working fluid is stagnant in the second space V2. Also, stagnation of the working fluid in the second space V2 may cause coagulation or precipitation depending on properties of the working fluid. However, in the above-described configuration, since the working fluid circulates without stagnation, it is possible to avoid coagulation or precipitation. In other words, the motor pump 200 can be used in any environment without being restricted by properties of a working fluid.

Although the second embodiment of the present invention has been described above, various changes and modifications can be made to the above-described configurations without departing from the gist of the present invention. For example, the number of compression stages provided is not limited to the above and may be two or less or four or more. Further, in the above-described embodiment, an example in which a portion in the vicinity of the suction port 44 of the compression section 3 is set as a third portion P3 has been described. However, a position of the third portion P3 is not limited to the above, and any portion in the compression section 3 can be set as the third portion P3 as long as the pressure of the working fluid is lower than that of the second space V2.

EXPLANATION OF REFERENCES

1 Rotating shaft
2 Driving section
3 Compression section
4 Casing
5 Partition member
6 First connection path
7 Pressure-equalizer
8 Second connection path
9 Third connection path
10 Pressure adjuster
21 Rotor core
22 Stator
31 Impeller
32 Disc
33 Blade
41 Driving section casing
42 Compression section casing
43 Connection casing
44 Suction port
71 Cylinder tube
72 Piston
73 Space
74 Space
100, 200 Motor pump
3*a*, 3*b*, 3*c* Compression stages
A Axis
F Compression flow path
P1 First portion
P2 Second portion
P3 Third portion
S1 Inner circumferential surface
S2 Outer circumferential surface
V1 First space
V2 Second space

What is claimed is:

1. A motor pump, comprising:
a shaft rotatable around an axis;
a driving section including a rotor core integrally fixed to an outer circumference of the shaft and a stator surrounding an outer circumference of the rotor core;
a compression section configured to compress a working fluid by rotating together with the shaft;
a casing surrounding the shaft, the driving section, and the compression section;
a partition radially partitioning an inside of the casing into a first space in which the stator is disposed and a second space in which the rotor core is disposed;
a first connection path connecting the first space to a first portion of the compression section; and
a second connection path connecting the second space to a second portion of the compression section in which a pressure of the working fluid is higher than that of the first portion.

2. The motor pump according to claim 1, further comprising a pressure-equalizer: (i) provided on the first connection path to partition the first connection path into a first region adjacent to the first portion and a second region adjacent to the first space; and (ii) configured to adjust so that a pressure on the first region equalized with a pressure on the second region.

3. The motor pump according to claim 2, wherein the pressure-equalizer includes:
a cylinder tube provided on the first connection path; and
a piston capable of being moved in a space of the cylinder tube between the first region and the second region.

4. The motor pump according to claim 1, wherein:
the first connection path is a pipe installed outside of the casing and connected from the first portion to the first space; and
the second connection path is a space between the casing and the shaft between the compression section and the driving section.

5. The motor pump according to claim 1, further comprising:
a third connection path connecting the second space to a third portion of the compression section in which the pressure of the working fluid is lower than that of the second space; and
a pressure adjuster provided on the third connection path and configured to cause the working fluid to flow in a state in which the pressure of the working fluid on a third region adjacent to the second space is higher than the pressure of the working fluid on a fourth region adjacent to the third portion in the third connection path.

6. The motor pump according to claim 1, wherein the partition is formed of a material having electrical insulation properties.

7. The motor pump according to claim 1, wherein the first space is filled with a fluid having better electrical insulation properties than the working fluid.

8. The motor pump according to claim 1, wherein:
the compression section includes a plurality of compression stages arranged in an axial direction in the casing and configured to gradually pressurize the working fluid suctioned from an upstream side in the axial direction toward a downstream side in series; and
the first portion and the second portion are respectively equivalent to different compression stages from each other, and the first portion is upstream of the second portion in the axial direction.

9. The motor pump according to claim 1, wherein:
the compression section includes a plurality of compression stages arranged in an axial direction in the casing and configured to gradually pressurize the working fluid suctioned from an upstream side in the axial direction toward a downstream side in series, and
the first portion and the second portion are arranged at one compression stage of the plurality of compression stages, and the first portion is upstream of the second portion in the axial direction in the one compression stage.

10. A motor pump, comprising:
a shaft rotatable around an axis,
a driving section including a rotor core integrally fixed to an outer circumference of the shaft and a stator surrounding an outer circumference of the rotor core;
a compression section including a plurality of compression stages and being configured to compress a working fluid by rotating together with the shaft;
a casing surrounding the shaft, the driving section, and the compression section;

a partition radially partitioning an inside of the casing into a first space in which the stator is disposed and a second space in which the rotor core is disposed;

a first connection path connecting the first space to a first of the plurality of compression stages; and a second connection path connecting the second space to a second of the plurality of compression stages, wherein, of the plurality of compression stages, the second of the plurality of compression stages is furthest downstream in the compression section.

* * * * *